US006699086B1

(12) United States Patent
Belter et al.

(10) Patent No.: US 6,699,086 B1
(45) Date of Patent: Mar. 2, 2004

(54) COOLANT MANAGEMENT SYSTEM FOR A MARINE PROPULSION DEVICE

(75) Inventors: David J. Belter, West Bend, WI (US); Wesley R. Martin, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/293,649

(22) Filed: Nov. 13, 2002

(51) Int. Cl.[7] ..... B63H 21/10
(52) U.S. Cl. ..... 440/88 C; 123/196 AB
(58) Field of Search ..... 440/88 R, 88 L, 440/88 C, 88 D, 88 K; 123/196 AB

(56) References Cited

U.S. PATENT DOCUMENTS

| | | | | |
|---|---|---|---|---|
| 4,498,875 A | | 2/1985 | Watanabe | |
| 4,735,590 A | | 4/1988 | Mondek | |
| 5,215,164 A | | 6/1993 | Shibata | |
| 5,232,387 A | | 8/1993 | Sumigawa | |
| 5,439,404 A | | 8/1995 | Sumigawa | |
| 5,462,464 A | | 10/1995 | Ming | |
| 5,487,687 A | | 1/1996 | Idzikowski et al. | |
| 5,704,819 A | | 1/1998 | Isogawa | |
| 5,876,256 A | | 3/1999 | Takahashi et al. | |
| 5,924,901 A | * | 7/1999 | Takahashi et al. | 440/88 L |
| 5,934,957 A | | 8/1999 | Sato et al. | |
| 5,937,801 A | | 8/1999 | Davis | |
| 6,012,956 A | | 1/2000 | Mishima et al. | |
| 6,182,631 B1 | | 2/2001 | Kitajima et al. | |
| 6,416,372 B1 | | 7/2002 | Nozue | |
| 6,634,913 B2 | * | 10/2003 | Shibata et al. | 440/88 C |

* cited by examiner

*Primary Examiner*—Andrew Wright
(74) *Attorney, Agent, or Firm*—William D. Lanyi

(57) ABSTRACT

A coolant management system for a marine propulsion device provides a cavity within a driveshaft housing into which an oil reservoir is disposed. A water pump draws water from a body of water and causes it to flow through various coolant passages of the marine propulsion device. After passing through these coolant passages, the water is directed through a series of containments and compartments so that the level of water within the driveshaft housing varies in depth as a function of the operating speed of the internal combustion engine. This variance in depth causes a varying degree of cooling of the oil within the oil reservoir or sump.

16 Claims, 7 Drawing Sheets

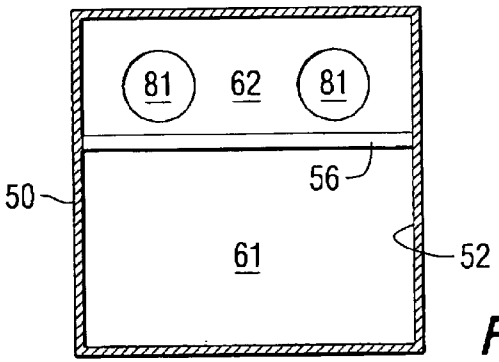
FIG. 4
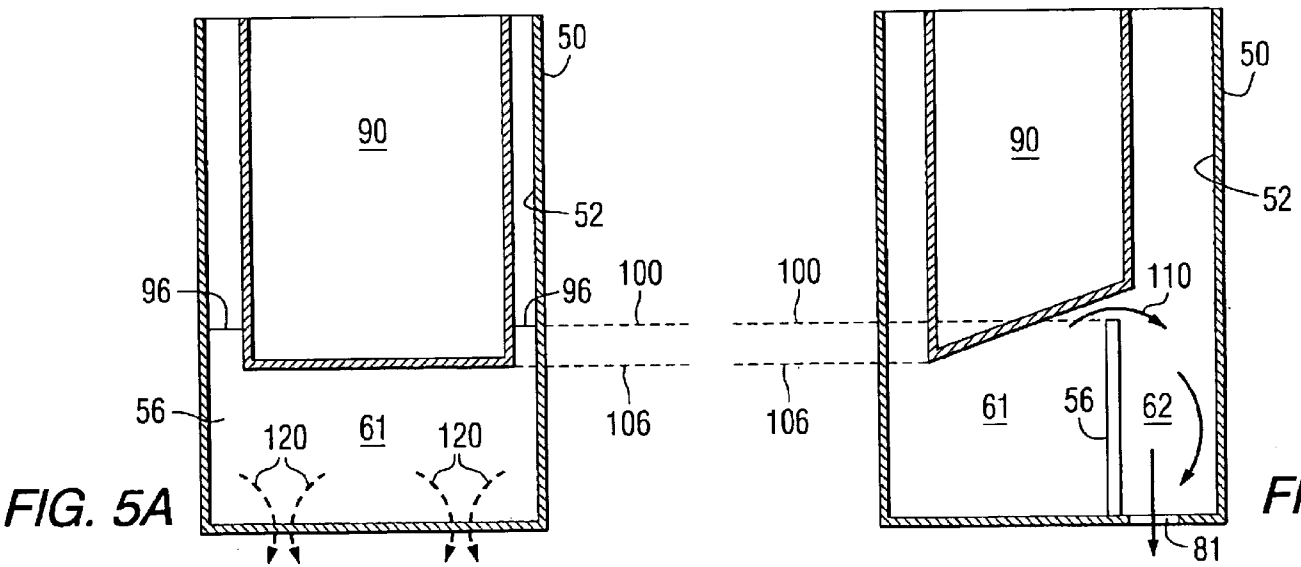
FIG. 5B
FIG. 5A

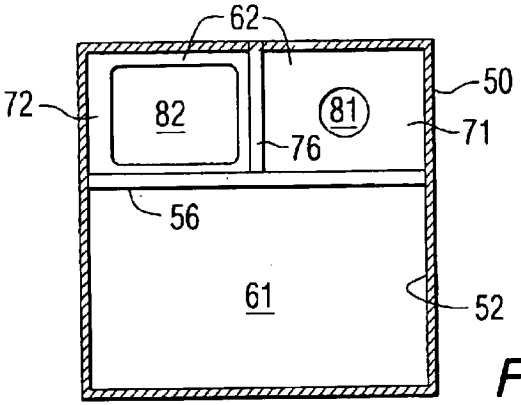
FIG. 6
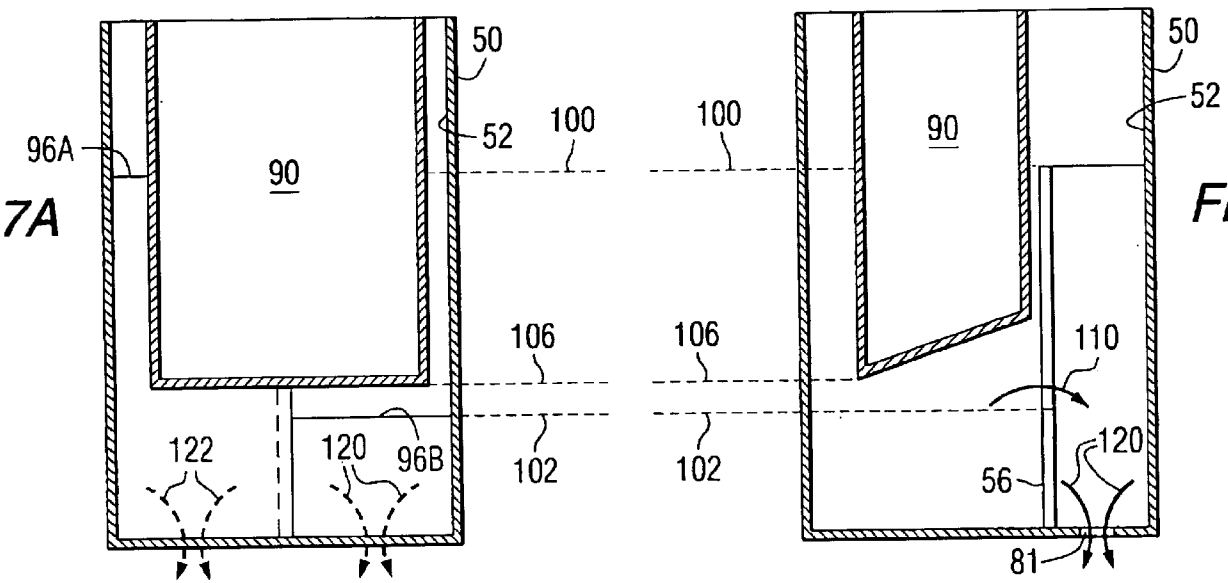
FIG. 7B
FIG. 7A

COOLANT MANAGEMENT SYSTEM FOR A MARINE PROPULSION DEVICE

BACKGROUND OF THE INVENTION

1. Field of the Invention

The present invention is generally related to a coolant management system and, more particularly, to a system and method for cooling the outer surface of an oil sump of an outboard motor by an amount that varies with the operating speed of an internal combustion engine of the outboard motor.

2. Description of the Prior Art

Four cycle engines are provided with an oil reservoir, or sump, which stores liquid lubricant that is used to lubricate moving components of the internal combustion engine and associated parts. It is important that the liquid lubricant is prevented from being overheated by heat generated by the internal combustion engine. It is also important that the temperature of the lubricant in the oil sump be prevented from falling below an appropriate operating range. Various systems and methods are known to those skilled in the art for controlling the operating temperature of a liquid lubricant within an oil sump.

U.S. Pat. No. 6,416,372, which issued to Nozue on Jul. 9, 2002, describes an outboard motor cooling system that includes an improved construction to enhance cooling of the lubricant system. It includes an oil pan of the lubrication system. The oil pan depends from an engine of the outboard motor and into a driveshaft housing. A periphery coolant jacket is provided around the oil pan. A water pool is defined between the oil pan and the driveshaft housing. An exhaust manifold passes through in a hollow of the oil pan and a water curtain is defined between the hollow wall and the exhaust manifold. An upstanding water passage is also disposed through the oil pan. At least one of an upper and lower transverse water jacket extends transversely above or below the oil pan. No drain water from the engine flows through these jackets or passages. The oil pan therefore is sufficiently cooled. In addition, the upper transverse water jacket increases protection of engine components form heat deterioration.

U.S. Pat. No. 6,182,631, which issued to Kitajima et al on Feb. 6, 2001, describes a camshaft for an engine. It also describes a cooling and exhaust system for the engine which are formed with a minimum number of components and sealing joints and which incorporate a non-metallic camshaft for reduced cost and weight without sacrificing durability. The exhaust system includes an elongated expansion chamber formed in the driveshaft housing. In addition, the driveshaft housing has a cylindrical section that is journaled within a swivel bracket for its steering movement. The volume between the external portion of the driveshaft housing and the internal portion of the swivel bracket forms a second expansion chamber that is employed for the low speed above the water exhaust gas discharge. The flow of cooling water to and from the engine is controlled so that the exhaust gas interchange area between the powerhead and the driveshaft housing will be well cooled as will the oil reservoir for the engine and the oil returned to it.

U.S. Pat. No. 6,012,956, which issued to Mishima et al on Jun. 9, 1998, describes a cooling water passage structure of an outboard motor. The outboard motor is equipped with an engine, an engine holder, an oil pan disposed below the engine in a state of the outboard motor being mounted to a hull, a water pump disposed below the oil pan, and a cooling water passage structure. The cooling water passage structure includes a vertical cooling water passage vertically passing through the inside of the oil pan and communicated with the side of the engine, a lateral cooling water passage extending in a lateral direction along a bottom surface of the oil pan, a cooling water supply pipe extending upward from the water pump and connected to a side of the engine, and a water pressure relief valve provided for the lateral cooling water passage for controlling a pressure increase of the cooling water. The lateral cooling waster passage has one end communicated with a lower end of the vertical cooling water passage and has another end to which an upper end of the cooling water supply pipe is connected.

U.S. Pat. No. 5,937,801, which issued to Davis on Aug. 17, 1999, discloses an oil temperature moderator for an internal combustion engine. A cooling system is provided for an outboard motor or other marine propulsion system which causes cooling water to flow in intimate thermal communication with the oil pan of the engine by providing a controlled volume of cooling water at the downstream portion of the water path. As cooling water flows from the outlet of the internal combustion engine, it is caused to pass in thermal communication with the oil pan. Certain embodiments also provide a pressure activated value which restricts the flow from the outlet of the internal combustion engine to the space near the oil pan. One embodiment of the cooling system also provides a dam within the space adjacent to the outer surface of the oil pan to divide that space into first and second portions. The dam further slows the flow of water as it passes in thermal communication with the oil pan.

U.S. Pat. No. 5,934,957, which issued to Sato et al on Aug. 10, 1999, describes an outboard motor having an oil pan positioned on the underside of the engine. It also has an exhaust passage, a water supply passage for cooling water, and a wastewater passage extending down from the engine and passing near the oil pan. The exhaust passage, the water supply passage, and the wastewater passage are molded as a single unit with the oil pan, and provide a simple, light-weight structure that does not result in an increase in the number of parts or assembly man hours necessary for construction. The oil pan is protected from the exhaust heat by the water passages, and a flush port to clean the cooling system is easily accessible.

U.S. Pat. No. 5,876,256, which issued to Takahashi et al on Mar. 2, 1999, describes an engine cooling system. A liquid cooling system for an internal combustion engine of an outboard motor includes a pump for delivering coolant to one or more coolant passages in the engine. At least one thermostat is provided for controlling the flow of coolant through the engine to one or more return lines which extend to a coolant pool extending about a lubricating oil reservoir. A pressure relief valve is provided between the pump and thermostat for relieving coolant from the engine upon excessive coolant pressure. The relief coolant is preferably either delivered to a drain, a second coolant pool extending about a muffler, or the first coolant pool. Preferably, a diverter is provided for controlling the flow of the relieved coolant. When a temperature of the lubricating oil is high, the relief coolant is preferably diverted to the first coolant pool for additional cooling of the oil in the reservoir, and when the temperature of the oil is low, the relieved coolant is preferably either diverted to the second coolant pool or the coolant drain for passage out of the motor.

U.S. Pat. No. 5,704,819, which issued to Isogawa on Jan. 6, 1998, describes an oil pan arrangement for a four cycle outboard motor. The outboard motor has a high performance V-type twin overhead cam four cycle internal combustion engine. The oil reservoir for the engine is disposed in a driveshaft housing below the engine and an oil pump is driven off the lower end of the engine crankshaft for circulating the oil from the oil tank to the engine. The oil supply system for the engine includes a vertically extending main gallery and a drain passage which extends in parallel side-by-side relationship and which are disposed over the oil tank for ease of oil return. The exhaust and cooling system for the engine is configured so as to minimize heat transfer between the exhaust system and the lubricating system and to maintain a compact assembly.

U.S. Pat. No. 5,487,687, which issued to Idzikowski et al on Jan. 30, 1996, discloses a midsection and cowl assembly for an outboard marine drive. The outboard marine drive has a midsection between the upper powerhead and the lower gearcase and has a removable midsection cowl assembly including first and second cowl sections. The midsection housing includes an oil sump in one embodiment and further includes an exhaust passage partially encircled by cooling water and partially encircled by engine oil for muffling engine exhaust noise. The midsection housing also has an oil drum arrangement providing complete and clean oil draining while the outboard drive is mounted on a boat and in the water wherein the operator can change oil without leaving the confines of the boat and entering the water.

U.S. Pat. No. 5,462,464, which issued to Ming on Oct. 31, 1995, describes an outboard motor with an oil sump cooling arrangement. A driveshaft housing includes outer side walls extending in spaced relation to each other, a forwardly located wall extending between the outer side walls, a rearwardly located wall spaced rearwardly from the forwardly located wall and extending between the outer side walls and a bottom wall extending between the outer side walls and between the forwardly and rearwardly located walls. The outer side walls, forwardly and rearwardly located walls, and bottom wall define an oil sump. A cooling passage extends vertically in one of the outer side walls. The forwardly located wall and the rearwardly located wall are adapted adjacent the upper end thereof for connection to a source of coolant. They terminate, at the lower end thereof, in a port located in the bottom wall and a deflector is fixed to the bottom wall and defines, with the bottom wall, a conduit extending along the bottom wall and having one end communicating with the coolant passage and a second end having an elongated discharge area, whereby to provide coolant flow along a substantial portion of the bottom surface of the bottom wall.

U.S. Pat. No. 5,439,404, which issued to Sumigawa on Aug. 8, 1995, describes a cooling system for an outboard motor. The cooling system for an outboard motor and specifically for the lubricating reservoir thereof is described. The lubricating reservoir depends into the driveshaft housing and is surrounded by an open trough-like water manifold to which cooling water is delivered from the engine. This manifold has lower restricted openings that direct the cooling water to the outer peripheral wall of the oil pan of the lubricant reservoir. The water level is maintained by a weir-like structure and the water that overflows the weir is also directed toward the outer surface of the lubricant reservoir.

U.S. Pat. No. 5,232,387, which issued to Sumigawa on Aug. 3, 1993, describes an exhaust device for a four cycle outboard motor. An arrangement is provided for the lubricating, cooling and exhaust systems of a four cycle outboard watercraft motor. Coolant is drawn from the body of water within which the watercraft is operated for circulation through the engine cooling system. Subsequently, the coolant is brought into proximity with an exhaust pipe extending downwardly from the engine within an encasing member. After passing downwardly along the exhaust pipe the coolant is finally directed towards an exhaust gas expansion chamber and a cooling water jacket provided around the expansion chamber. In order to prevent any of the cooling water from splashing back up against an oil reservoir, also located within the casing, a cover is provided across the tops of the expansion chamber and its accompanying cooling water jacket. Cooling water or air may fill the voids separating the various components contained within the encasing. The arrangement is particularly effective in preventing the corrosion of the oil reservoir housing due to backsplashed coolant when the watercraft is operated in saltwater; cooling the components contained within the encasing; and, minimizing heat transfer from higher temperature operating components to lower temperature operating components.

U.S. Pat. No. 5,215,164, which issued to Shibata on Jun. 1, 1993, describes a lubricating device for a four stroke outboard motor. A number of embodiments of outboard motors including dry sump lubricated four cycle internal combustion engines is described. The dry sump lubrication system includes a scavenge pump for drawing lubricant drained from the engine lubricating system through an inlet port and returns it to a dry sump reservoir through an outlet port and a pressure pump that draws lubricant from the dry sump lubricant reservoir through an inlet port and delivers it to the engine lubricating system through an outlet port. At least one of the ports of each of the pumps is positioned above the normal lubricant level in the lubricant reservoir when it is filled with the normal volume of lubricant so as to insure that lubricant will not drain back into the engine when the pump system is not operating. Various arrangements for achieving this result and for cooling the lubricant are described.

U.S. Pat. No. 4,735,590, which issued to Mondek on Apr. 5, 1988, describes a lubrication system for a marine propulsion device. The marine propulsion device comprises a propulsion unit including an internal combustion engine, a pump driven by the engine, a transom bracket for mounting the propulsion unit to the transom of a boat, a fluid reservoir carried by the transom bracket, a fluid cooler is carried by the transom bracket for cooling the fluid contained in the reservoir and a conduit for communicating the cooled oil to the pump is provided.

U.S. Pat. No. 4,498,875, which issued to Watanabe on Feb. 12, 1985, describes an outboard motor. Two embodiments of water cooled, four cycle internal combustion engines used for outboard motors is described. In each embodiment, an arrangement is provided that offers a compact nature and which issued the coolant delivered to the engine for cooling the oil in the oil pan. In addition, an arrangement is provided whereby the exhaust pipe may pass through the oil pan and yet avoid significant heat transfer from the exhaust system to the lubricating system. In each embodiment of the invention, coolant is delivered to this clearance for further cooling the exhaust system. In one embodiment of the invention, an arrangement is provided for limiting the discharge of coolant from the clearance so as to maintain a level of coolant around the exhaust pipe.

The patents described above are hereby expressly incorporated by reference in the description of the present invention.

Although it is very important that the oil within an oil reservoir or sump is maintained at a temperature less than an upper limit which can degrade and deteriorate the lubricating characteristics of the oil, it is also very important that the oil in the oil sump or reservoir be maintained at a temperature above a lower limit. In certain situations, the oil in the oil sump can be cooled to an excessive degree, particularly when the internal combustion engine of the marine propulsion device is operating at a low speed. When the internal combustion engine is initially started and while it is operating at relatively low operating speeds, such as idle speed, it is beneficial if the oil in the oil reservoir is allowed to absorb sufficient heat to maintain its temperature within an appropriate temperature range. It would be significantly beneficial if a coolant management system could assist in maintaining the operating temperature of the oil in the oil sump within the desired temperature range while requiring a minimum number of components to accomplish this function.

SUMMARY OF THE INVENTION

A coolant management system for a marine propulsion device, made in accordance with a preferred embodiment of the present invention, comprises an internal combustion engine having a coolant passage disposed in thermal communication with at least one heat producing portion of the internal combustion engine, a water pump having an inlet connected in fluid communication with a body of water in which the marine propulsion device is operated and an outlet connected in fluid communication with the coolant passage. It also comprises a cavity formed within the marine propulsion device and an oil reservoir disposed at least partially within the cavity. An inlet passage is connected in fluid communication within the coolant passage and the cavity. A drain passage is connected in fluid communication with the cavity to allow the water to drain from the cavity and return to the body of water in which the marine propulsion device is operated. The drain passage is sized to cause the water within the cavity to rise to a level which is at least partially a function of the operating speed of the internal combustion engine, whereby the magnitude of the surface area of the oil reservoir disposed in thermal communication with the water within the cavity is a function of the operating speed of the internal combustion engine.

In a particularly preferred embodiment of the present invention, the system further comprises a first wall within the cavity which defines a first containment and a second containment. The inlet passage is positioned to conduct water from the coolant passage to the first containment. The drain passage is disposed in the second containment.

In a preferred embodiment of the present invention, the system further comprises a second wall disposed within the second containment to define a first compartment and a second compartment. The drain passage comprises a first opening in the first compartment and a second opening in the second compartment. The first wall has an upper edge that, in one embodiment, is generally straight and, in another embodiment, a portion of the oil reservoir, or sump, is lower than the upper edge of the first wall. The cavity is disposed within a driveshaft housing of the marine propulsion device which, in a preferred embodiment is an outboard motor. The method of the present invention for managing the coolant flow in a marine propulsion device, in a preferred embodiment, comprises the steps of providing a pump for drawing water from a body of water in which the marine propulsion device is operating, directing the water into thermal communication with an internal combustion engine of the marine propulsion device, conducting the water into a cavity formed within the marine propulsion device at a first rate of flow which is a function of the operating speed of the internal combustion engine, wherein the cavity is shaped to contain an oil reservoir of the internal combustion engine, and conducting the water out of the cavity at a second rate of flow, whereby the first and second rates of flow determine the height of a level of water within the cavity as a function of the operating speed of the internal combustion engine.

BRIEF DESCRIPTION OF THE DRAWINGS

The present invention will be more fully and completely understood from a reading of the description of the preferred embodiment in conjunction with the drawings, in which:

FIGS. 4, 5A, and 5B show a second embodiment of the present invention;

FIGS. 6, 7A, and 7B show a third embodiment of the present invention;

DESCRIPTION OF THE PREFERRED EMBODIMENT

Figure 1:
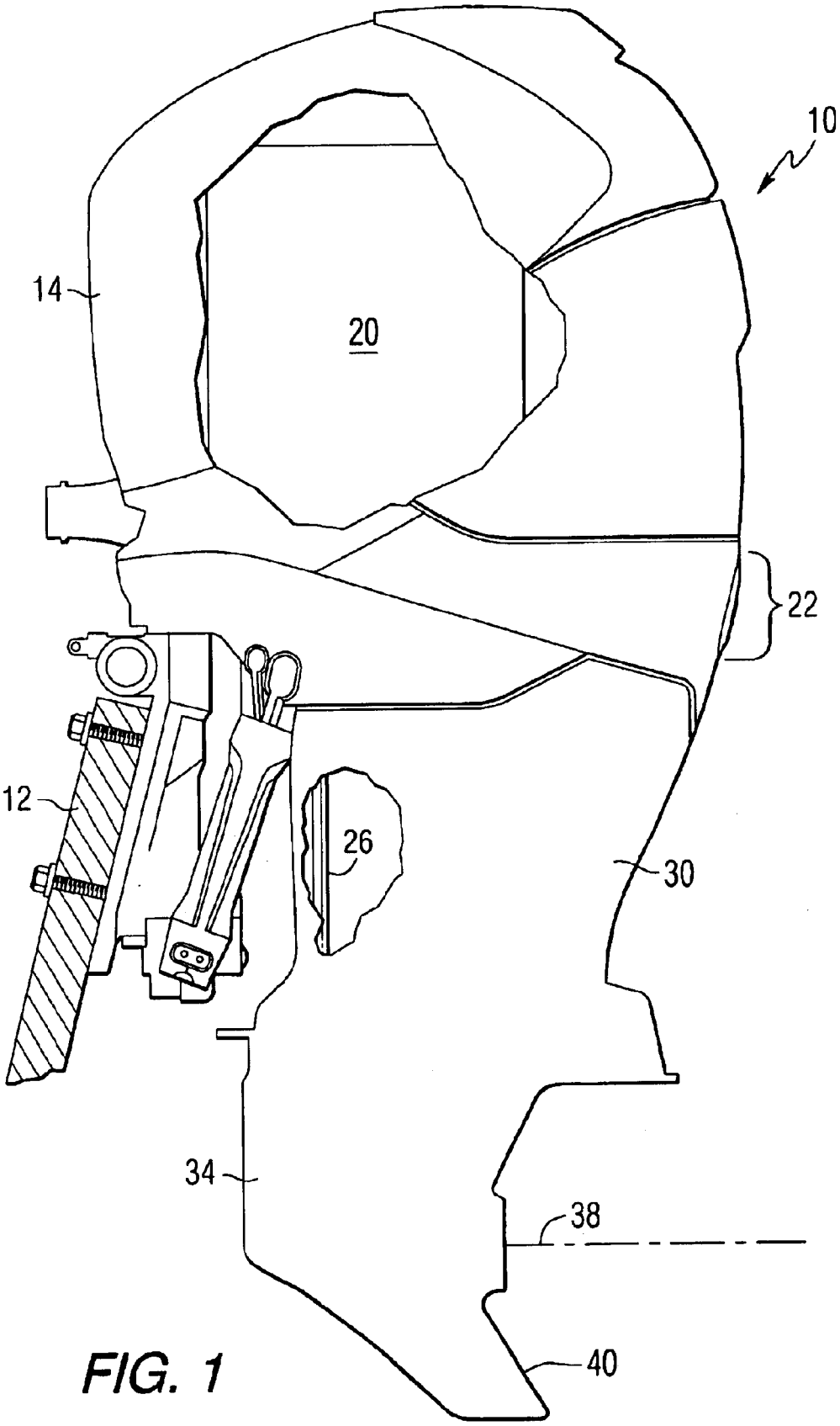
FIG. 1 is a simplified silhouette representation of a marine propulsion device.

Throughout the description of the preferred embodiment of the present invention, like components will be identified by like reference numerals.

FIG. 1 is a side view of an outboard motor 10. The outboard motor 10 is shown in silhouette in order to allow the basic structure to be described. The outboard motor 10 is attachable to a transom 12 of a marine vessel. The outboard motor comprises a cowl structure 14 that encloses an internal combustion engine 20 and associated components. The cowl 14, shown in FIG. 1, is a two piece cowl. The engine 20 is supported by an adapter plate which is located in the general vicinity identified by reference numeral 22. A driveshaft 26 extends downwardly from the engine 20 for rotation about a vertical axis. The driveshaft 26 is contained within a driveshaft housing 30. A gearcase 34 is supported below the driveshaft 30 and a propeller shaft (not shown in FIG. 1) is connected in torque transmitting relation with the driveshaft 26 and supported by the gearcase 34 for rotation about a propeller shaft axis 38. A skeg 40 is located at the lowermost portion of the outboard motor 10. As will be described in greater detail below, an oil sump is supported below the engine 20 and contained within a cavity of the driveshaft housing 30. A water pump is connected in torque transmitting relation with the driveshaft 26 and draws water upwardly, through inlet openings in the gearcase 34, and causes the water to be pumped upwardly toward the internal combustion engine 20 through appropriate conduits and into coolant passages formed within the structure of the engine 20. The coolant passages within the internal combustion engine 20 can be in various shapes and configurations which are very well known to those skilled in the art. The coolant passages typically comprise cavities and channels cast into the structure of the engine block and cylinder head structure of the engine 20.

The present invention will be described in terms of three alternative embodiments. One embodiment will be described below in conjunction with FIGS. 2, 3A, and 3B. Another embodiment will be described in conjunction with FIGS. 4, 5A, and 5B. A third embodiment will be described in conjunction with FIGS. 6, 7A, and 7B. FIGS. 2–7B are illustrated in a highly simplified schematic manner in order to allow the basic principles of the present invention to be described. Beginning with FIG. 8, the present invention will be described in conjunction with illustrations that more accurately depict a prototype of the present invention in the general form of the embodiment described in a more basic manner in conjunction with FIGS. 2, 3A, and 3B.

Figure 2:
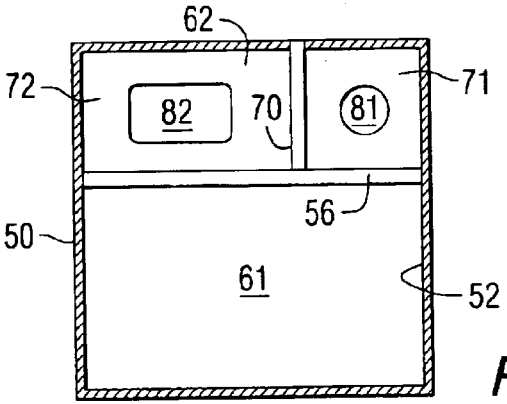
FIGS. 2, 3A, and 3B illustrate a first embodiment of the present invention.

FIG. 2 is a section view, viewed in a downward direction through a structure 50, within the driveshaft housing 30 that defines a cavity 52. A first wall 56 within the cavity 52 defines a first containment 61 and a second containment 62. In other words, the first wall 56 divides the cavity 52 into the first and second containments, 61 and 62. A second wall 70 is disposed within the second containment 62 to define a first compartment 71 and a second compartment 72. A drain passage comprises drain opening 81 and drain opening 82. As can be seen, drain opening 81 is in the first compartment 71 and drain opening 82 is in the second compartment 72.

Figure 3B:
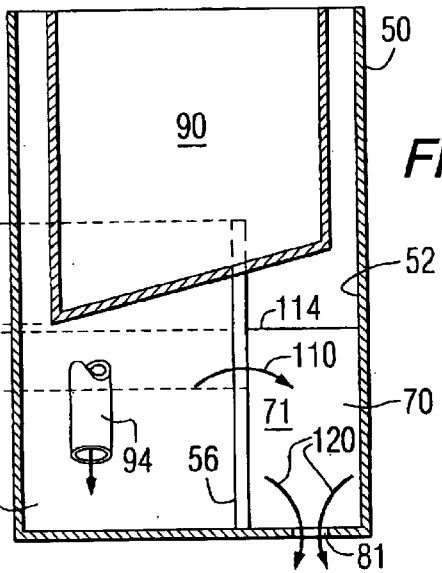
Figure 3A:
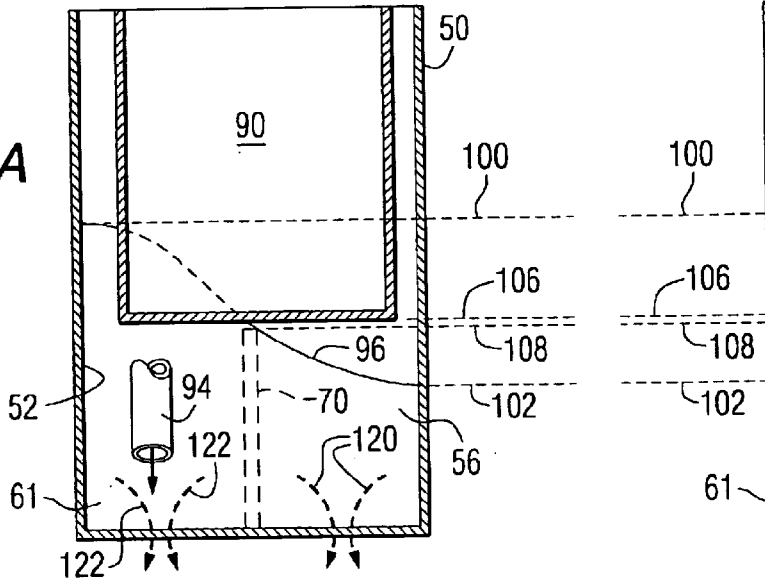

FIG. 3A is a front section view of this structure 50 that defines the cavity 52. FIG. 3B is a port side section view of the structure 50 with its internal components. In addition to the elements described above in conjunction with FIG. 2, an oil reservoir 90 is disposed at least partially within the cavity 52. The oil reservoir 90 is an oil sump that contains a quantity of liquid lubricant for use in lubricating moving components of the internal combustion engine 20.

An inlet passage 94 is schematically represented in FIGS. 3A and 3B for the purpose of showing the location at which water is conducted into the first containment 61 after it is passed through the coolant passages of the engine and through other conduits of the coolant system. The water flows through the inlet passage 94 into the first containment 61 and fills that containment to a level which is determined by both the upper edge 96 of the first wall 56 and the rate of flow of water from the inlet passage 94. Although the inlet passage 94 is represented as a single conduit in FIGS. 3A and 3B, it should be understood that water can be directed to flow into the first containment 61 from more than one source.

In FIG. 3A, the second wall 70 is shown in dashed lines because it is located behind the first wall 56 in that figure. In FIG. 3B, the higher portion of the first wall 56 extends partially behind the oil reservoir 90. As can be seen in FIGS. 3A and 3B, the upper edge 96 of the first wall 56 is curved. It has an upper end 100 and a lower end 102 which are represented by dashed lines in FIGS. 3A and 3B. It can also be seen that the lower surface of the oil reservoir 90 is slanted, with the front portion of the oil sump, represented by dashed line 106 being lower than the back edge of the bottom surface. Dashed line 108 represents the height of the second wall 70.

In operation, water flowing through the entire cooling system, under the pressure provided by a water pump, flows into the first containment 61. As a result, the water level in the first containment 61 will rise until it reaches a height coincident with dashed line 102. At that height, the water can begin to spill over the first wall 56 from the first containment 61 into the second containment 62 and, more particularly, into the first compartment 71. This spill over of water is represented by arrow 110 in FIG. 3B. As the water pours over the upper edge 96 of the first wall 56 into the first component 71 of the second containment 62, some of that water drains out of the first compartment 71 through drain opening 81. If the water spilling over the upper edge 96 of the first wall 56 is insufficient to overcome the amount draining through the drain opening 81, the water level within the first compartment 71 will not rise appreciably. However, if the rate of water flow from the inlet passage 94 is sufficiently high, the rate of water pouring over the upper edge 96 of the first wall 56 will be greater than the water draining through drain opening 81. As a result, the water level within the first compartment 71 will rise until it eventually reaches the top 114 of the second wall 70. The water will then begin to spill over the top 114 of the second wall 70 from the first compartment 71 into the second compartment 72 which has a much larger drain opening 82. Depending on the rates of flow of water through the inlet passage 94, the water level within the second compartment 72 may begin to rise as the water flowing into it exceeds the drain capacity of drain opening 82. As a result, the water level within the cavity 52 will rise.

As the water rises within the cavity 52, ever increasing magnitudes of the outer surface of the oil sump 90 are placed in contact with the water. Since the water rises within the cavity 52 as a function of the relative rates of flow of water through the inlet passage 94 and through the drain openings, 81 and 82, the cooling effect on the oil reservoir 90 increases as a function of increasing engine speed.

With continuing reference to FIGS. 2, 3A, and 3B, dashed line arrows 120 represent the water draining through drain opening 81, dashed line arrows 122 represent the water draining through drain opening 82, and arrows 120 in FIG. 3B also represent the water draining through drain opening 81.

It should also be understood that the rate of water draining through drain openings 81 and 82 is also affected by the height of the water level above those drain openings. In other words, the pressure head caused by the depth of water within cavity 52 affects the rate of draining. As a result, the flow rate of water flowing into the first containment 61 through the inlet passage 94, in combination with the rate of flow through the drain passage will determine the height of water within the cavity 52. These variables will also determine the amount of outer surface area of the oil sump 90 that is wetted by the rising water within cavity 52. In many types of marine propulsion devices, the water pump operates at a speed that is directly related to the rotational speed of the driveshaft 26 because the water pump is connected in torque transmitting relation with the driveshaft 26, usually by a set of gears.

FIGS. 4, 5A, and 5B show an alternative embodiment of the present invention that is similar to the embodiment shown in FIGS. 2, 3A, and 3B, but with several noticeable differences. First, as can be seen in FIG. 4, no second wall 70 is shown. Instead, the first wall 56 divides the cavity 52 into first and second containments, 61 and 62. The drain passage comprises drain openings 81. The second containment 62 is not divided into first and second compartments. With reference to FIGS. 5A and 5B, water is conducted into the first containment 61 by an inlet passage similar to the inlet passage 94 described above in conjunction with FIGS. 3A and 3B. The water level in the first containment 61 rises until it reaches the upper edge 96 of the first wall 56. It then spills over the first wall 56, as represented by arrow 110, and begins to drain out through the drain openings 81. If the drain openings 81 are appropriately sized, the level of water in the second containment 62 will depend on the relative rates of flow of cooling water through the inlet passage 94 and the flow of water through the drain openings 81. When the engine is operating at a relatively high speed, the pump will create a flow of cooling water into the system that exceeds the rate at which the water is draining out of the second containment 62 through drain openings 81. This will cause the water to rise and immerse some of the outer surface of the oil sump 90 in cooling water. At even higher speeds, the water level will rise sufficiently to immerse a greater amount of surface area of the oil sump 90 and thereby reduce the temperature of the oil. The relative positions of the top edge 96 of the first wall 56, as represented by dashed line 100, and the lowest portion of the oil sump 90, represented by dashed line 106, will determine the amount of surface area of the oil sump 90 that is in contact with the cooling water for various heights of water in the cavity 52.

The embodiment shown in FIGS. 4, 5A, and 5B, differs from the previously described embodiment by the absence of the second wall 70 within the second containment 62 and the shape of the upper edge 96 of the first wall 56, which is generally straight in FIG. 5A but curved in FIG. 3A. In addition, the two drain openings 81 in FIG. 4 are generally equal in size while drain opening 82 in FIG. 2 is significantly larger than drain opening 81.

Another embodiment of the present invention is shown in FIGS. 6, 7A, and 7B. Comparing this embodiment to the embodiment shown in FIGS. 2, 3A, and 3B, it can be seen that the first wall 56 in FIG. 7A has upper edges, 96A and 96B, which are located at different heights. Upper edge 96A is identified by dashed line 100 while upper edge 96B is identified by dashed line 102. Drain opening 82 is noticeably larger than drain opening 81. The other components shown in FIGS. 6, 7A, and 7B, are identified by the same reference numerals as used to describe and identify those same components in the Figures described above.

During operation, water is conducted into the first containment 61 by an inlet passage similar to the inlet passage 94 shown in FIGS. 3A and 3B. For the purpose of simplifying the illustrations, the inlet passage 94 is not shown in FIGS. 7A and 7B. As the first containment 61 fills with water, its level eventually reaches the upper edge 96B, at which time it begins to spill over the upper edge 96B as represented by arrow 110. This water flows into the first compartment 71 of the second containment 62. If the water flowing through the inlet passage 64 exceeds the rate of the water flowing out of drain opening 81, the water level will rise to the upper edge 96A of the first wall 56 and eventually will flow into the second compartment 72 from both the first containment 61 and the first compartment 71. Again, as described above in conjunction with the first two embodiments, the water level rising within the cavity 52 will move into thermal communication with the outer surface of the oil sump 90 and this thermal communication will increase as a function of engine speed because the water pump operates at a speed that is directly related to the rotational speed of the driveshaft 26 which was described above in conjunction with FIG. 1.

The three embodiments described above, in conjunction with FIGS. 2–7B, illustrate different ways in which the basic concepts of the present invention can be implemented to manage the coolant system of a marine propulsion device such as an outboard motor.

Figure 8:
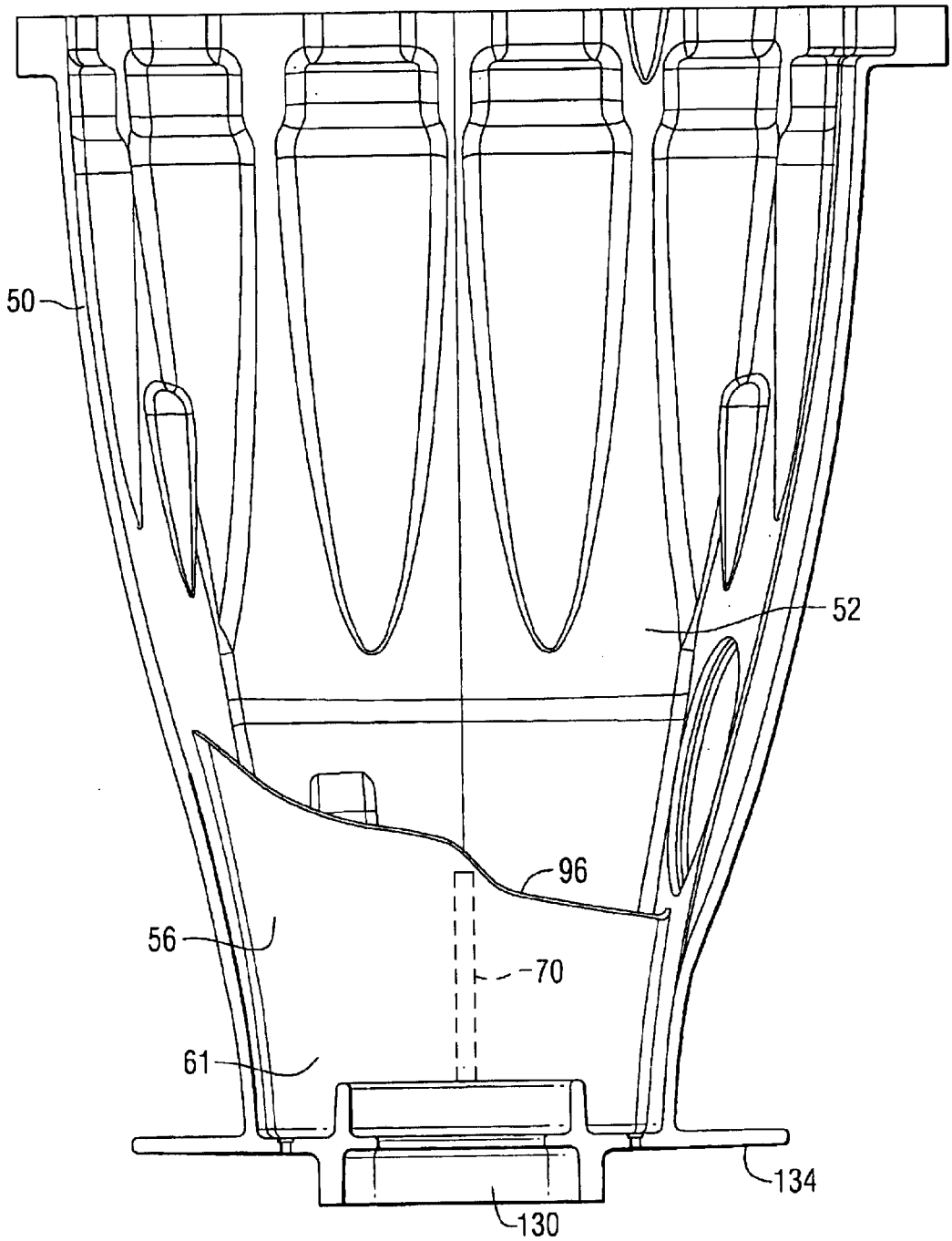
FIG. 8 is a section view of a driveshaft housing incorporating the present invention.

FIG. 8 is an actual containment 50 which implements the embodiment of the present invention described in conjunction with the simplified schematic representations in FIGS. 2, 3A, and 3B. The oil sump 90 is not shown in FIG. 8. However, the first wall 56 with its upper edge 96 can be seen, extending from left to right, in its position to define the first containment 61 and second containment 62 within the cavity 52. Represented by dashed lines, the second wall 70 is perpendicular to the representation in FIG. 8 and disposed behind the first wall 56. As described above, the function of the second wall 70 is to divide the second containment 62 into first and second compartments, 71 and 72. The illustration in FIG. 8 is a section view from the front of the outboard motor. An exhaust opening 130. Reference number 134 identifies an anti-ventilation plate.

Figure 9:
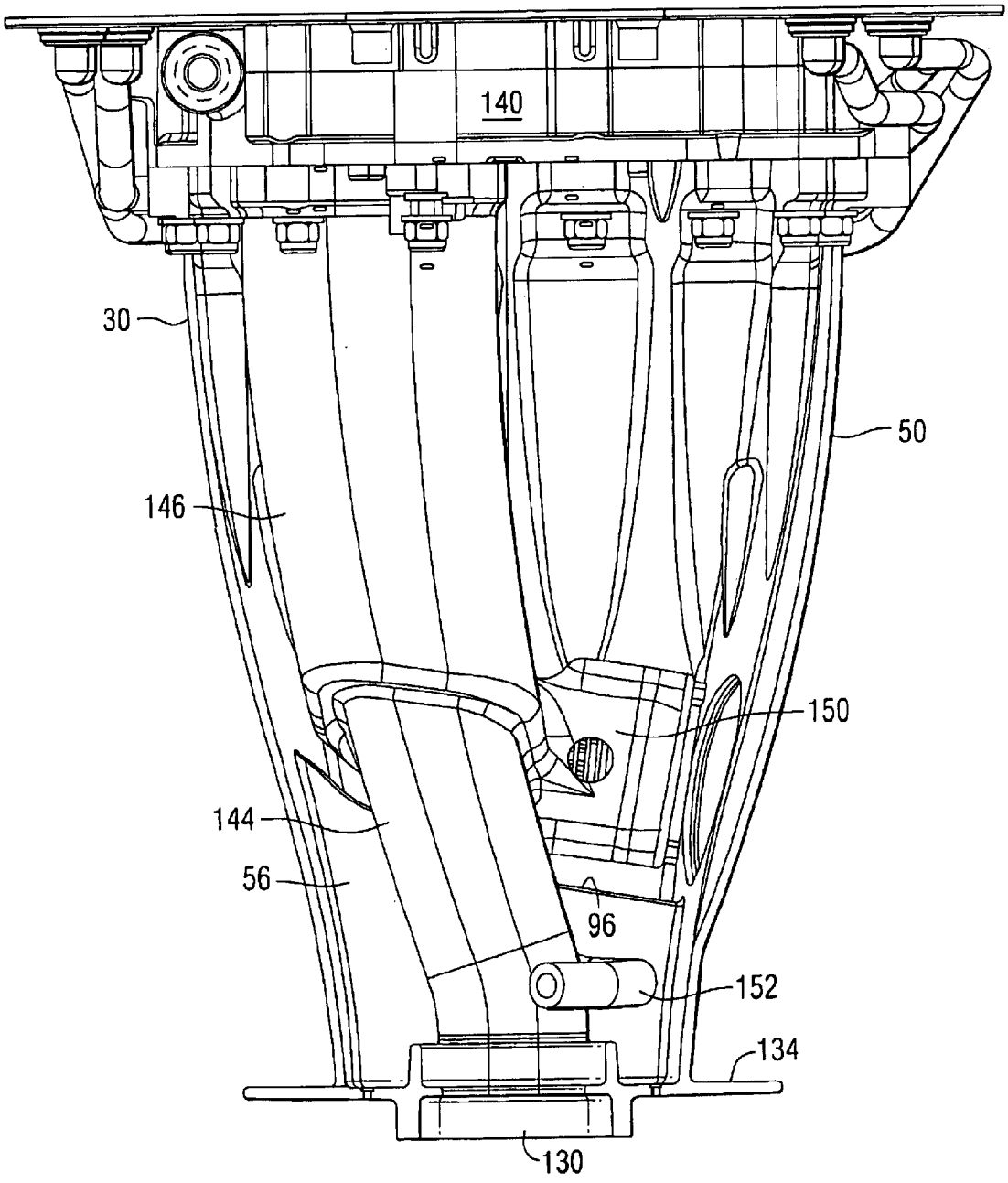
FIG. 9 is generally similar to FIG. 8 but with additional components illustrated.

FIG. 9 is a section view, viewed from the front of the driveshaft housing, which is similar to the section view of FIG. 8, but with certain additional components added to the illustration. An adaptor plate 140 is shown at the top portion of FIG. 9. As is generally known to those skilled in the art, the adaptor plate 140 is located within the outboard motor and supports the internal combustion engine 20. The driveshaft housing 30 is supported downwardly from the adaptor plate 140. In FIG. 9, an exhaust conduit 144 conducts exhaust gases downwardly through the driveshaft housing 30 from an opening in the adaptor plate 140. The exhaust gases, which result from the operation of the internal combustion engine 20, are conducted downwardly toward and through the exhaust opening 130. A water jacket 146 surrounds a portion of the exhaust conduit 144. The first wall 56 is shown in FIG. 9 directly behind the unjacketed portion of the exhaust conduit 144. A pressure regulator is located in the compartment identified by reference numeral 150. A drain conduit allows water to flow from the pressure regulator 150 to allow the water to drain into the first containment 61.

Figure 10:
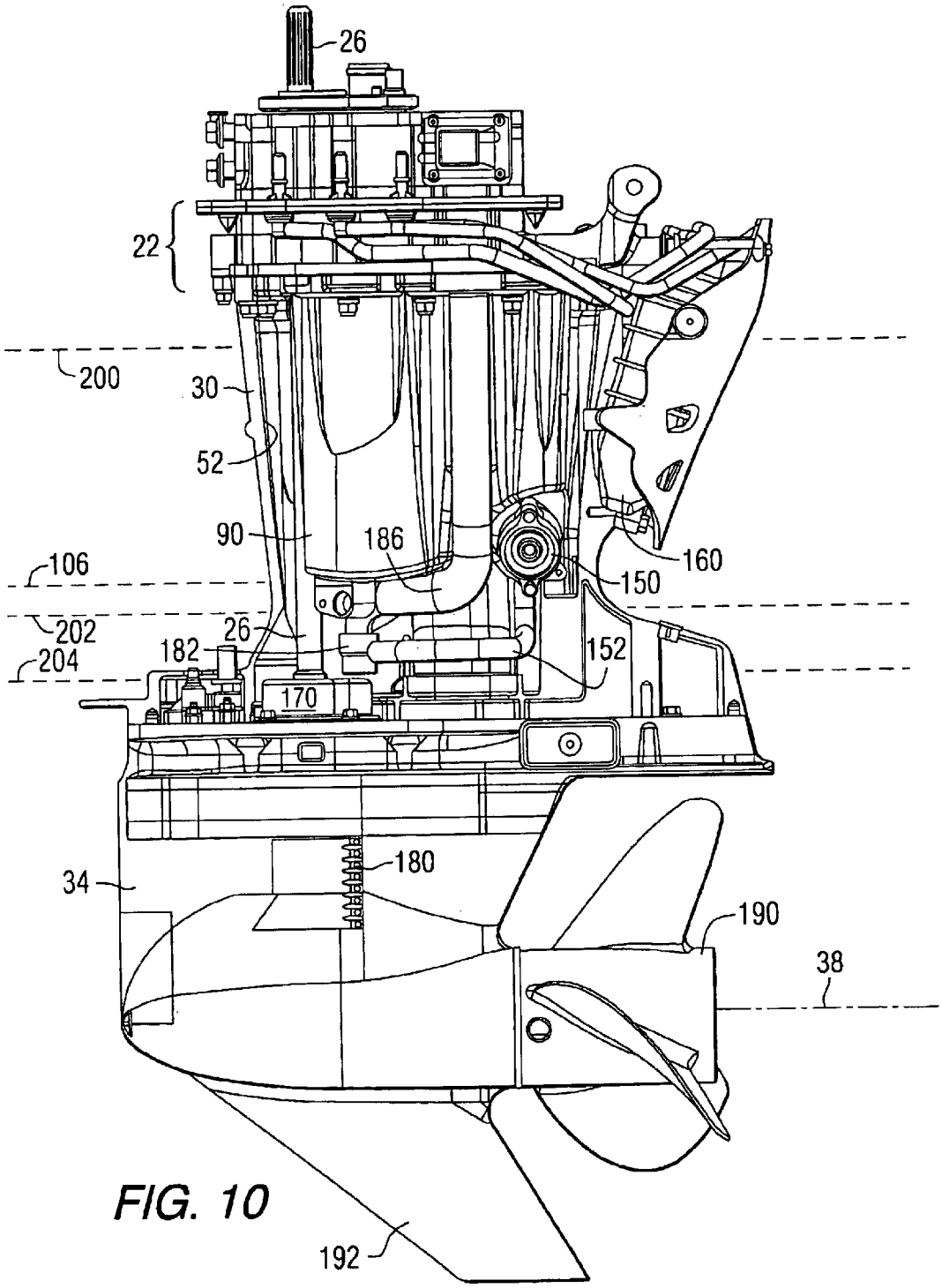
FIG. 10 is generally similar to FIG. 9, but with additional components illustrated.

FIG. 10 is a section view of a driveshaft housing 30 with the oil reservoir 90 disposed within a cavity 52. An adaptor plate region 22 is shaped to support an internal combustion engine having a crankshaft disposed in torque transmitting relation with the driveshaft 26. Although not directly related to the concepts of the present invention, FIG. 9 also shows a fuel vapor separator 160 attached to the aft portion of the driveshaft housing 30. The water pump 170 has a rotatable portion that turns in coordination with the driveshaft 26 to pump water from a plurality of water inlets 180 in the gearcase 34. The water is drawn into the inlets 180, which is below water level, and pumped upwardly from the pump 170 to its outlet 182. From the outlet 182 of the pump 170, water is caused to flow upwardly through conduit 186 and, eventually, into cooling passages of the internal combustion engine 20 described above in conjunction with FIG. 1.

With continued reference to FIG. 10, a propeller 190 is attached to a propeller shaft within the gearcase 34 for rotation about axis 38 as described above. A skeg 192 extends downwardly from the gearcase 34.

The outboard motor, made in accordance with the preferred embodiment of the present invention, is subjected to various water levels within the cavity 52 of the driveshaft housing 30, depend on the operating speed of the internal combustion engine 20 and the rotational speed of the driveshaft 26. At higher rotational speeds of the driveshaft 26, the pump 170 will provide cooling water to the engine at increasing rates of flow. These increasing rates of flow will result in the cooling water within the cavity 52 rising to increased heights around the oil reservoir 90. The precise height of the water level within the cavity 52 and surrounding the oil reservoir 90 will vary as a function of the flow rate of coolant provided by the pump 170 to the coolant passages of the internal combustion engine 20, the relative sizes of the drain openings, 81 and 82, and the height of the water itself which provides a pressure head that can affect the rate at which water flows through the drain openings. As an example, when the internal combustion engine 20 is operating at maximum speed, one particularly embodiment of the present invention will cause the water within cavity 52 to rise to a level represented by dashed line 200. A significant portion of the outer surface area of the oil reservoir 120 is submerged in water contained within the cavity 52 when the upper level of the water in the cavity is at dashed line 200. In comparison, when the internal combustion engine 20 is operating at very low speeds, and the boat is still on plane, the level of water within the cavity 52 of the driveshaft housing 30 can fall to a level which is represented by dashed line 202. At idle speed the driveshaft housing fills to the outside water level which can be as high or higher than line 200. For purposes of reference, dashed line 204 represents the minimum height of water necessary to maintain the water pump 170 in a submerged state. Dashed line 106 illustrates the bottom edge of the oil reservoir 90.

With reference to FIGS. 1–10, it can be seen that the present invention provides a coolant water management system for a marine propulsion device which causes the depth of water within the cavity 52 of the driveshaft housing 30 to vary in magnitude as a general function of the operating speed of the internal combustion engine 20. At increased operating speeds, the water pump 170 draws water through inlet 180 at a rate which exceeds the rate of draining through various drain openings, such as those identified by reference numerals 81 and 82. This causes the water level to rise within the cavity 52. The rate at which water drains through the drain openings, 81 and 82, is a function of the height of water above the drain passage. Therefore, as the water level within the cavity 52 of the driveshaft housing 30 increases, the rate of draining also increases. If the drain openings are properly sized, as appropriate high speed water depth 200 can be empirically determined for any particular style of propulsion device. The first and second walls, 56 and 70, are used to divide the cavity 52 into first and second containments, 61 and 62. The second wall 70, in particular, is used to divide the second containment 62 into first and second compartments, 71 and 72, in certain embodiments of the present invention. By directing coolant into the first containment 61, after it is passed through various passages of the internal combustion engine and related components, the flow of coolant water from the engine can be sequentially directed to the first containment 61, the first compartment 71 of the second containment 62, and then the second compartment 72 of the second containment 62. By appropriately placing the empirically sized drain openings, 81 and 82, in the first and second compartments, 71 and 72, of the second containment 62, the water level within the cavity 52 can be selected for the range of operating speeds of the engine 20. By controlling the depth of coolant within the cavity 52 of the driveshaft housing 30, the amount of outer surface area of the oil reservoir 90 can be controlled. This, in turn, allows the rate of cooling of the oil within the oil reservoir 90 to be controlled as a function of engine speed.

Several different embodiments of the present invention have been described. A first embodiment is described in conjunction with FIGS. 2, 3A, and 3B. The second embodiment is described in conjunction with FIGS. 4, 5A, and 5B. A third embodiment is described in conjunction with FIGS. 6, 7A, and 7B. The embodiment illustrated in FIGS. 2, 3A, and 3B is illustrated in greater detail in FIGS. 8–10.

Although the present invention has been described with particular detail to show these various embodiments and has been illustrated with specificity, it should be understood that alternative embodiments are also within its scope.

We claim:

1. A coolant management system for a marine propulsion device, comprising:

an internal combustion engine having a coolant passage disposed in thermal communication with at least one heat producing portion of said internal combustion engine;

a water pump having an inlet connected in fluid communication with a body of water in which the marine propulsion device is operated and an outlet connected in fluid communication with said coolant passage;

a cavity formed within said marine propulsion device;

an oil reservoir disposed at least partially within said cavity;

an inlet passage connected in fluid communication between said coolant passage and said cavity; and a drain passage connected in fluid communication with said cavity to allow said water to drain from said cavity and return to said body of water in which said marine propulsion device is operated, said drain passage being sized to cause said water within said cavity to rise to a level which is at least partially a function of said operating speed of said internal combustion engine, whereby the magnitude of the surface area of said oil reservoir disposed in thermal communication with said water within said cavity is a function of said operating speed of said internal combustion engine;

a first wall within said cavity which defines a first containment and a second containment; and a second wall disposed within said second containment to define a first compartment and a second compartment.

2. The system of claim 1, wherein:

said inlet passage is positioned to conduct water from said coolant passage to said first containment.

3. The system of claim 2, wherein:

said drain passage is disposed within said second containment.

4. The system of claim 1, wherein:

said drain passage comprises a first opening in said first compartment and a second opening in said second compartment.

5. The system of claim 1, wherein:

said first wall has an edge that is generally straight.

6. The system of claim 1, wherein:

a portion of said oil reservoir is lower than an edge of said first wall.

7. The system of claim 6, wherein:

said water pump is disposed within said first containment.

8. The system of claim 7, wherein:

said water pump is disposed below said edge of said first wall.

9. The system of claim 1, wherein:

said cavity is disposed within a drive shaft housing of said marine propulsion device.

10. The system of claim 1, wherein:

said marine propulsion device is an outboard motor.

11. A method for managing the cooling flow in a marine propulsion device, comprising the steps of:

providing a pump for drawing water from a body of water in which said marine propulsion device is operating;

directing said water into thermal communication with an internal combustion engine of said marine propulsion device;

conducting said water into a cavity formed within said marine propulsion device at a first rate of flow which is a function of an operating speed of said internal combustion engine, said cavity being shaped to contain an oil reservoir of said internal combustion engine therein;

conducting said water out of said cavity at a second rate of flow, whereby said first and second rates of flow determine the height of a level of said water within said cavity as a function of said operating speed of said internal combustion engine;

providing a first containment within said cavity; and providing a second containment within said cavity, said second containment comprising a first compartment and a second compartment.

12. The method of claim 11, wherein:

said level of said water within said cavity determines the magnitude of the surface area of said oil reservoir which is disposed in thermal communication with said water.

13. The method of claim 11, wherein:

said water being conducted into said cavity at said first rate of flow is conducted into said first containment.

14. The method of claim 13, wherein:

said water being conducted out of said cavity at said second rate of flow is conducted out of said second containment.

15. The method of claim 14, further comprising:

providing a flow path for said water to flow from said first containment to said second containment.

16. The method of claim 11, further comprising:

providing a flow path from said first compartment to said second compartment.

* * * * *